United States Patent [19]

Stöberl

[11] 4,030,436

[45] June 21, 1977

[54] FOLDABLE OUTBOARD SEAT FOR SAILBOATS

[76] Inventor: Helmuth Stöberl, 8201 Eggstatt-Bachham Haus near 9, Germany

[22] Filed: Oct. 3, 1975

[21] Appl. No.: 619,176

[30] Foreign Application Priority Data

Oct. 7, 1974 Germany ..... 2447710

[52] U.S. Cl. ..... 114/39; 9/7; 297/333

[51] Int. Cl.[2] ..... B63B 29/00

[58] Field of Search ..... 114/39, 124; 9/7, 1 C, 9/1 D; 297/3, 283, 332, 333

[56] References Cited

UNITED STATES PATENTS

| | | | |
|---|---|---|---|
| 1,759,878 | 5/1930 | Zizzo | 297/333 |
| 2,347,931 | 5/1944 | Bromagem | 297/333 |
| 2,965,155 | 12/1960 | Henrikson et al. | 297/333 |
| 3,862,456 | 1/1975 | Fisher | 114/39 |

*Primary Examiner*—Trygve M. Blix
*Assistant Examiner*—Gregory W. O'Connor
*Attorney, Agent, or Firm*—Hill, Gross, Simpson, Van Santen, Steadman, Chiara & Simpson

[57] ABSTRACT

An outboard folding seat for sailboats consisting of a hinged seat member pivotable between an inboard position wherein an outside face forms a part of the peripheral boat deck top and an outboard position wherein an inside face forms a seat member.

8 Claims, 4 Drawing Figures

FOLDABLE OUTBOARD SEAT FOR SAILBOATS

BACKGROUND OF THE INVENTION

1. FIELD OF THE INVENTION

This invention relates to boats and more particularly to a seat member pivotable to an outboard position for sailboats.

2. PRIOR ART

Sailboats, particularly small sailboats are often sailed at an angle to the wind which causes the boat body to tilt rather drammatically. In order to equalize this wind force, it is common for the sailor to use his body as a counterweight by leaning outwardly in an effort to use his weight to trim the boat. In the case of one man sailboats, this is frequently done by having the sailor utilize a strap member affixed to the interior of the boat which is then grasped around the feet or ankles thereby allowing the sailor to hang the upper part of his body outwardly over the edge of the boat. This type of weight-trimming of the boat is very tiresome and quite inconvenient. In addition it presents a danger to the sailor, not only in that awkward maneuvering of the boat can occur, but also, in the case of heavy waves, the sailor may be jostled and it is possible for the sailor to fall into the water.

It would therefore be an improvement in the art of sailboats to provide means allowing the sailor to place his weight outboard of the boat with relative comfort and safety.

SUMMARY OF THE INVENTION

My invention provides such a means and device in that, according to the invention, a seat member is rotatably affixed by means of a hinge to the main boat body adjacent a front edge of the seat and a side edge of the boat body and is pivotable outwardly from a storage position integrated with the inboard portions of the boat body into an outboard weight-trimming seat forming position.

As a further feature of the invention, the hinge is constructed as a pivotable fitting with the addition of return or storage position replacement springs which will automatically return the seat from the weight-trimming position ot the boat body integral storage position. Preferably the hinge member extends over the entire width of the seat member.

Additionally, according to a further feature of this invention, the outside surface of the seat member is equipped with a support strut arm which is automatically swung outwardly to a support position by means of gravity upon extension of the seat member to its hikingout or weight-trimming position. The support strut arm supports the seat member in weight-trimming position by abuttment against the boat hull outer surface.

An outboard folding seat constructed according to the teachings of this invention can be swung outwardly to the weight-trimming position by the sailor without engaging in complex maneuvers through the use of a handle or the like. The seat will be supported in the weighttrimming position through the hinge connection and the support strut arm which will contact the boat hull outer surface. In this way, weight-trimming forces will be advantageously distributed over the boat body in a manner which will prevent the creation of any above average strains on the boat body. By means of the return spring, the outer seat, upon release by the sailor will be folded back to a point where a counterspring will engage to take care that the seat is returned both automatically and easily into a boat deck recess provided for receipt of the seat.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
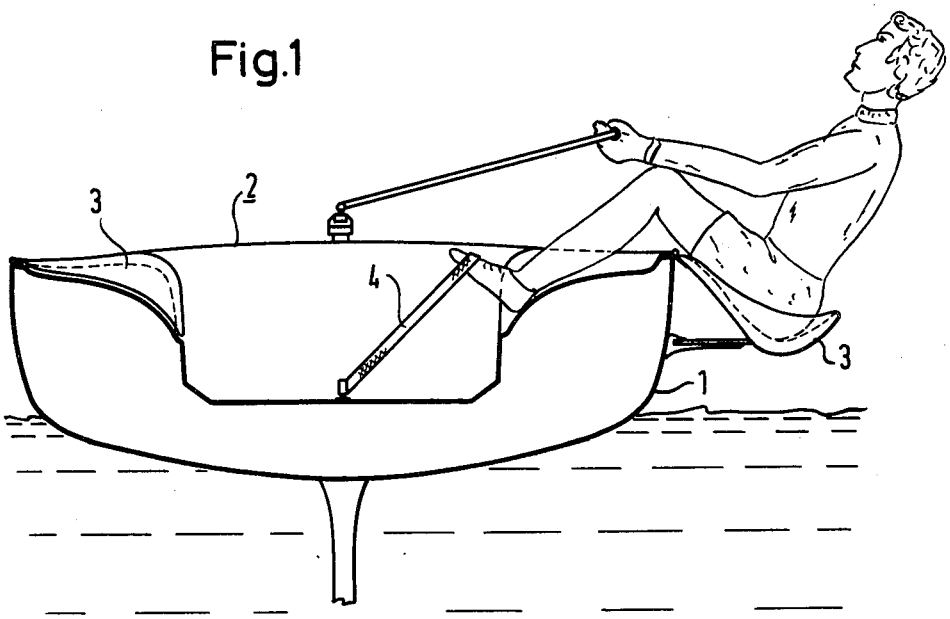
FIG. 1 is a fragmentary diagrammatic cross section view through the hull of a sailboat equipped with the seat of this invention with a sailor illustrated in a hiking-out or weight-trimming position.

FIG. 1 illustrates a cross section through the hull 1 of a small sailboat illustrating the outboard-foldable seat 3 which, according to the teachings of this invention is provided for weight-trimming of the sailboat during hiking-out. The seat 3 is illustrated, on the right hand side of the drawing, in the weight-trimming position and, on the left hand side of the drawing, in a folded-in storage position integrated into the boat body. In the folded-in position, the sailor can sit in the usual manner on the back side of the seat which extends in the plane of the deck 2. In this manner, the sailor will be able to manipulate the boat from a normal position with his feet in the cockpit. If, however due to an increase in wind strength, or an anglation of sail position with respect to the wind, the boat undergoes a slanting or tilting which requires a weight-trimming, the seat member 3 can be folded outwardly and thereby offer the sailor a convenient and safe seating arrangement during the weight-trimming operation. By forming the section of the boat hull which encompasses the seat when it is in the folded- in position illustrated on the left hand side in such a manner as to provide a recess, the recess space in the deck area will thereby become open upon folding out of the seat allowing the lower legs of the sailor to be positioned substantially more conveniently than would otherwise be possible. Due to this lower positioning of the legs upon hikingout of the deck, less force will be required in order to hold the sailor securely with his feet in the hiking strap 4.

In the storage or folded-in position illustrated on the left hand side of the drawing, the seat will be fully integrated with the deck area 2 of the boat body in such a way that only the peripheral separating joints of the seat will be visible.

Figure 2:
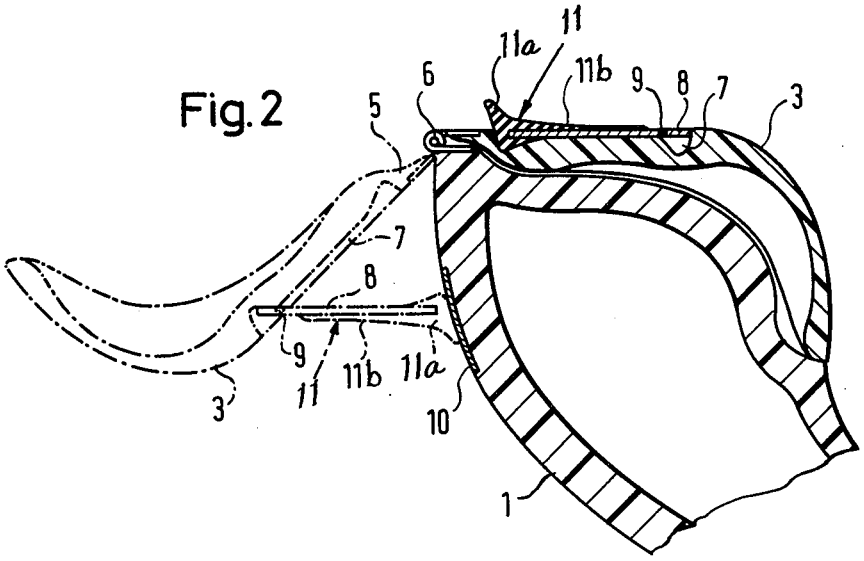
FIG. 2 is a fragmentary cross section view of portions of the boat hull and weight-trimming seat of this invention.
Figure 3:
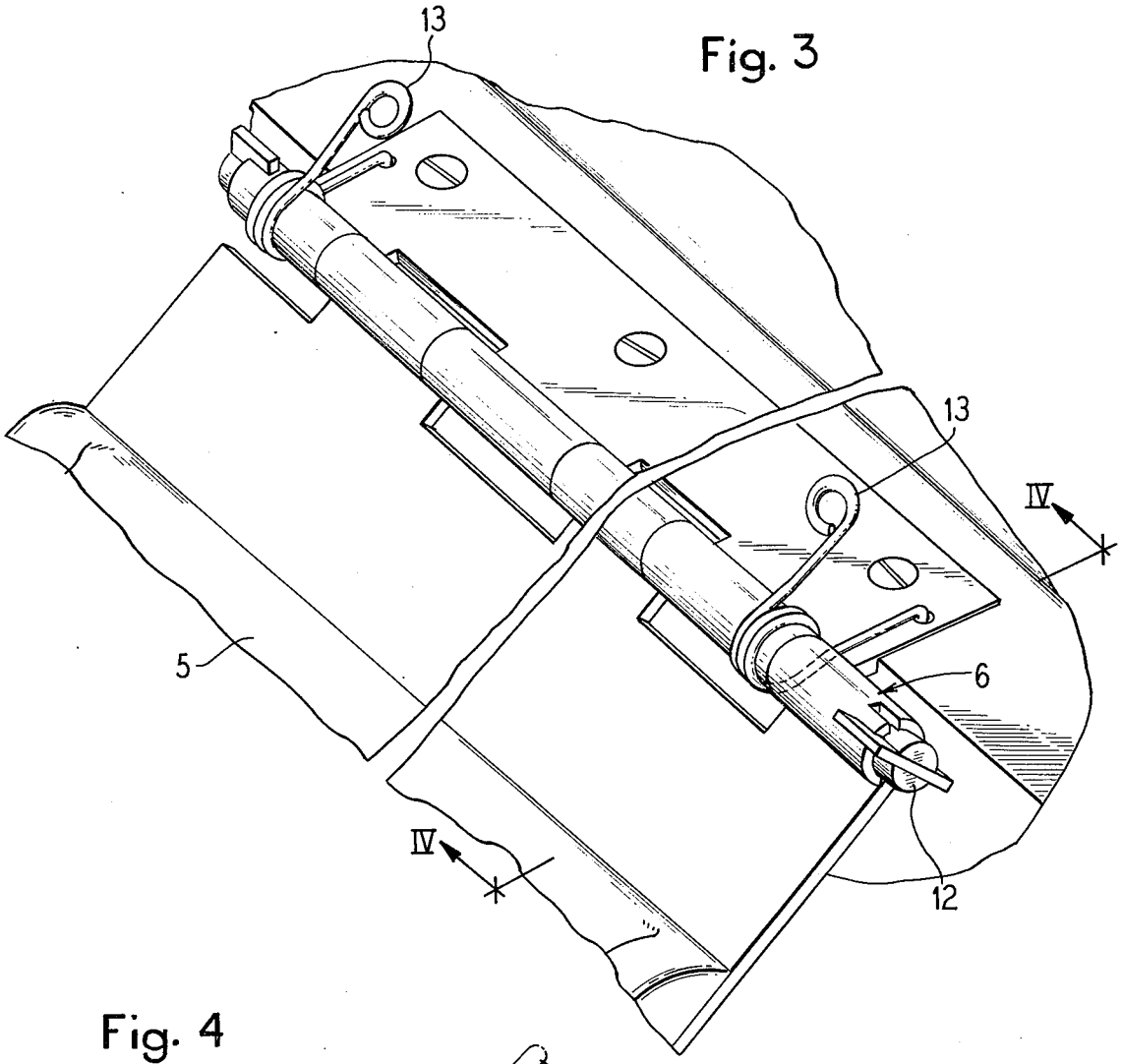
FIG. 3 is a fragmentary view of the hinge connection of the seat to the boat hull.
Figure 4:
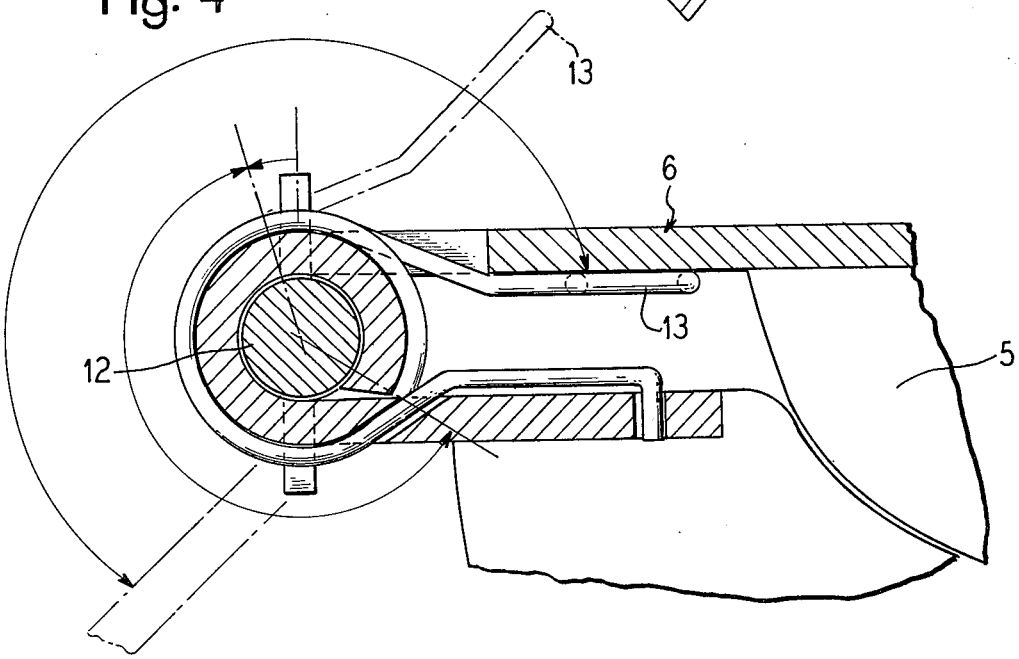
FIG. 4 is a cross section taken along the lines III-III of FIG. 3.

FIG. 2 illustrates, in greater detail, by means of a fragmentary cross sectional view, the outboard foldable seat of this invention and its attachment to the boat hull. The front edge 5 of the foldable seat is connected to one side of a hinge member 6, the other side of which is tightly anchored in the hull of the boat at the periphery thereof. The hinge 6 preferably extends over the entire width of the foldable seat and is constructed as a pivotably member or mounting having return springs 12 which, preferably, are adjustable in their return force. The return springs may be constructed in the form of helical springs or as torsion bar springs 12 which will be loaded upon rotation of the hinge and therefore the foldable seat. Preferably, the spring force is adjusted in such a manner that the outer seat upon pivoting to the weight-trimming position must overcome a return force so that upon release, the seat will tend to return to its storage position due to the return force of the spring. In order that the foldable seat, upon swinging back, does not strike hard against the body of the boat, countersprings 13 may be provided which will become effective upon rotation of the foldable seat through approximately ¾ of its pivoting area. The counterspring will damp the force of the return spring to an extent which will permit the seat to fold back gently into the recess provided for its receipt in the deck area of the boat body. The two return springs 12, will preferably be positioned at the tubular part of the hinge 6 and will extend out over the entire width of the seat to provide a uniform force application.

A recess 7 is provided on the outer side of the foldable seat and has a pivotably supported strut arm member 8 arranged therein. The strut arm member 8 has its axis of rotation 9 eccentrically positioned along the length thereof, so that upon swinging out of the foldable seat 3, the strut arm member will project outwardly due to gravitational forces until it shorter lever arm comes into contact with a stop member formed in the bottom of the recess 7. When in this position, a seat supporting edge will lie on the front end of the longer lever arm which will be in contact with the boat hull. In order to prevent damage to the boat hull when the supporting edge is in contact therewith and to provide a non-slip seat surface, the arm 8 may be covered with a rubber member 11 which will insure as wide as possible a force applying surface. The boat body itself may be provided with a stiffening plate 10 which, for example, may consist of a steel plate which extends over the outer surface of the boat body in the area in which the strut arm will contact the boat hull and which is fixedly anchored in the boat body. The rubber member 11 may be constructed in such a manner that it projects outwardly to one side to extend above the plane of the boat deck and thereby be effective as a seat edge 11*a* for a sailor sitting in a normal seated position on the deck when the seat is folded into its storage position. The seat edge may be continued inwardly beyond the end of the support strut arm 8 in order to provide a slide resist seating surface 116. It is to be understood that the support strut arm may be relatively wide so as to effectively spread the force application against the body of the boat hull over a larger area.

In the preferred form of the invention, the seat is designed and adapted to the anatomical conditions of the human body and, particularly it is contoured to provide a comfortable supporting surface for the body during the weight-trimming or hiking-out position. For this purpose, for example, the upper part of the short back rest as illustrated, can be contoured and provided with a bead member in order to impart support to the outer seat while at the same time conforming to the human body. Also the recess in the boat deck into which the outer seat is foldable may be provided with a contoured surface to receive the lower legs and heels respectively of the sailor to provide a form fitting rest point therefore.

It can therefore be seen from the above that my invention provides a pivotable outboard-foldable seat for sailboats which is provided with a storage position inboard of the hull wherein it forms an extension of the deck and cockpit wall surface, the seat being foldable into an outboard position wherein it forms a seat for a sailor and wherein the positioning of the seat is determined by a gravity actuated strut member formed in an outer surface of the seat which drops into position to brace the seat in the desired outboard position at an angle to the normal deck plane. The pivotable connection to the boat may include return and counterforce springs which will automatically return the seat to its storage position.

Although the teachings of my invention have herein been discussed with reference to specific theories and embodiments, it is to be understood that these are by way of illustration only and that others may wish to utilize my invention in different designs or applications.

I claim as my invention:

1. A sailboat comprising: a boat hull having an interior depressed cockpit bordered by a raised deck area, a seat member having outer surfaces, the seat member pivotably atached to the boat hull adjacent an outside edge thereof along a front edge of the seat, the seat pivotable between an inboard storage area with outer surface portions of the seat lying substantially flush with the deck area and other portions of outer surfaces of the seat lying substantially flush with a wall of the cockpit to an outboard position with inner surfaces of the seat forming a support for a sailor outboard of the boat hull, a recess in the portion of the outer surface of the seat which lies flush with the deck area when the seat is in the storage position, a pivotable strut member pivotably received in said recess, said strut member gravity actuated upon movement of the seat from the storage position to the outboard position to move portions of the strut member out of said recess and into contact with an outer wall portion of the boat hull, said strut member effective to limit movement of the seat member outwardly of the boat and to provide support for the seat member in the outboard position.

2. In combination with a sailboat having a hull with a deck well portion for storing an outboard seat, a seat member fitting said well having a back surface portion contoured to lie flush with the deck and a front surface portion contoured to provide a seat, said seat member having a forward edge pivotably connected to the sailboat hull adjacent the outer periphery of the sailboat, a seat bottom portion extending from said forward edge, and an up-standing back rest portion at the outer end of the seat portion, said seat member being pivoted from a storage position in said well inboard of said boat hull to an outboard position projecting laterally from the boat hull with the major portion of the seat bottom portion and all of the back rest portion lying beyond the boat hull.

3. The combination of claim 7 wherein the pivotable connection includes a first spring device biased to return the seat from the outboard position to the storage position and a second spring device effective to snub the returning action of the first spring device for preventing a slamming of the seat in the well.

4. The combination of claim 2 wherein the back surface of the seat member has a gravity actuated arm strut member pivotably attached thereto, the stru:

member pivoting from a stored position to a strut supporting position upon movement of the seat from the inboard storage position to the outboard position, the strut member having an end portion contacting an outer surface portion of the hull of the boat outboard of the boat when the seat is in the outboard position.

5. The combination of claim 4 wherein the strut member has a resilient boat hull contacting end.

6. The combination of claim 5 wherein the boat hull has a plate receiving said resilient end of the strut.

7. The combination of claim 4 wherein said resilient end has an upwardly projecting bead member on the outer surface of the seat when the seat and strut member are in storage position and said bead forms a seat edge defining projection.

8. The combination of claim 2 wherein the inner surfaces of the seat member are contoured to correspond with the anatomy of the human body, the seat in the storage position projecting into the boat deck well, the well having an outer surface of compound contours corresponding to those positions of the human anatomy which will project into the well when a person is sitting in the seat in the outboard position.

* * * * *